US006109073A

United States Patent [19]

Parsons

[11] Patent Number: 6,109,073

[45] Date of Patent: Aug. 29, 2000

[54] SELF-ALIGNING HANDCUFF KEY

[75] Inventor: Kevin L. Parsons, Appleton, Wis.

[73] Assignee: Armament Systems and Procedures, Appleton, Wis.

[21] Appl. No.: 08/634,276

[22] Filed: Apr. 18, 1996

[51] Int. Cl.[7] ..... E05B 75/00

[52] U.S. Cl. ..... 70/16; 70/16; 70/403; 70/404; 70/408

[58] Field of Search ..... 70/16, 403, 404, 70/408, 395, 400, 401, 407, 409, 456 R, 453, 454, 491

[56] References Cited

U.S. PATENT DOCUMENTS

| | | | |
|---|---|---|---|
| 113,499 | 4/1871 | Cheney | 70/16 |
| 367,829 | 8/1887 | Meinhard | 70/408 |
| 1,094,478 | 4/1914 | Ryan | 70/408 |
| 1,509,335 | 9/1924 | Bockin | 70/16 |
| 1,903,586 | 4/1933 | Arnold et al. | 70/408 |
| 1,929,235 | 10/1933 | Bevington | 70/408 |
| 3,339,384 | 9/1967 | Greenwald | 70/454 |
| 4,403,487 | 9/1983 | Marty | 70/408 |
| 4,778,302 | 10/1988 | Martinez | 70/456 R X |
| 5,460,022 | 10/1995 | Parsons | 70/456 R |
| 5,568,741 | 10/1996 | Parsons | 70/456 R |
| 5,613,381 | 3/1997 | Savage | 70/16 |

FOREIGN PATENT DOCUMENTS

| | | | |
|---|---|---|---|
| 0170762 | 2/1986 | European Pat. Off. | 401/195 |
| 640136 | 7/1928 | France | 70/408 |
| 21560 | 10/1905 | Germany | 70/16 |
| 275644 | 6/1914 | Germany | 70/403 |
| 3133093 | 3/1983 | Germany | 70/408 |
| 4101461 | 8/1991 | Germany | 70/408 |
| 651001 | 1/1963 | Italy | 70/16 |
| 17233 | 11/1888 | United Kingdom | 70/408 |
| 21797 | 10/1914 | United Kingdom | 70/16 |

*Primary Examiner*—Lloyd A. Gall
*Attorney, Agent, or Firm*—McDonnell Boehnen Hulbert & Berghoff

[57] ABSTRACT

A handcuff key having a shank on which is mounted a paddle offset from the end of the shank so that a portion of the shank protrudes beyond the end of the paddle. The key has a first asymmetrical gripping surface as well as a second cylindrical gripping surface. The gripping surfaces are formed of an elastomer while the offset paddle and shank are formed of metal. The key is also provided with a quick release cap which snaps over a double-lock stem extending from the key. In an alternative embodiment, the quick-release cap is provided with an offset key ring to permit the key to hang substantially vertical from an officer's uniform or key ring during storage.

30 Claims, 4 Drawing Sheets

SELF-ALIGNING HANDCUFF KEY

BACKGROUND OF THE INVENTION

1. Field of Invention

This invention is generally related to restraining devices for use by law enforcement personnel and is specifically directed to an asymmetrical, self-aligning key for lockable restraining device such as handcuffs.

2. Description of the Prior Art

Handcuff keys are generally utilized in environments that make it difficult or impossible to visually inspect a key to ascertain its orientation before attempting to insert the key in the keyhole of a handcuff. If one is physically able to inspect a key in these situations, such an inspection may still not be possible without distracting one's attention from a suspect. Handcuff keys of the prior art do not lend themselves to use in such situations because of the necessity to visually inspect the keys for orientation purposes.

Typical prior art handcuff keys, such as the keys shown in FIGS. 1*a*–1*b*, are provided with a shank 1 having an unlocking paddle 2 mounted flush with one end of the shank 1, a gripping surface 3, and a double-lock engaging stem 4 extending from the end of the key opposite the end bearing the unlocking paddle. The key may be cylindrical (FIG. 1*a*), having a gripping surface disposed about the cylinder of the key, or symmetrical (FIG. 1*b*), having a gripping surface in substantially the same plane as the unlocking paddle. A key ring 5 can also be provided to permit attachment of the key to the belt of a law enforcement officer. Prior art handcuff keys have heretofore been fabricated of metal only.

In any case, the paddle-bearing end of the shank is intended to mate with a socket in a standard, ratchet and pawl metallic handcuff. Specifically, the key is inserted into the keyhole of a handcuff. The keyhole shape is defined by an annular aperture intersecting with a rectangular notch. This shape corresponds to the cross-sectional shape of the paddle-bearing end of the shank such that the key can be inserted into the handcuff when the notch of the keyhole is aligned with the paddle of the key. Once inserted into a handcuff, the key is turned to disengage the teeth of the ratchet with the teeth of the pawl.

Most modern handcuffs are provided with a double lock feature, wherein a bolt in the handcuffs lock mechanism can be selectively positioned to prevent the pawl from disengaging the ratchet. This feature is activated by depressing a pusher or sliding bar within the handcuff with the double-lock engaging stem of the key. The pusher or bar urges the bolt into a double locked position. The bolt is disengaged by inserting the key into the handcuff keyhole and rotating the key in a first direction. The key may then be counter-rotated to unlock the handcuff.

Handcuffs and handcuff keys are typically utilized in environments that often make it difficult to engage and disengage the locking mechanism of the handcuffs using the above described prior art handcuff keys because the keys must be visually inspected to ascertain the orientation of the paddle relative to the handcuff keyhole. Specifically, arresting officers may be faced, among other things, with poor lighting, struggling suspects, and/or wet conditions such as those which may foster mud or other debris which could interfere with insertion of a key in a keyhole. In any event, conditions such as these can often hinder use of the prior art handcuff key.

More particularly, the position of the paddle on the shank of these keys requires that the paddle be aligned with the notch of the handcuff keyhole before the key can be seated with or inserted into the handcuff. Those skilled in the art will understand that the flush mounted paddle necessitates proper alignment of the key with the keyhole before the paddle can pass through the keyhole. This type of precise alignment requires visual inspection by the user. However, even before the paddle can be properly aligned, the axis of the key must be aligned with the axis of the annular portion of the keyhole. Under conditions described above, proper alignment of the keyhole axis with the key shank axis can be difficult. In most cases, an officer, aided with visual inspection if possible, must simply slide and rotate the paddle-bearing end of the key in the approximate vicinity of the keyhole until the key seats in the keyhole. This process of hit-or-miss is undesirable because it can distract an officer's attention from a suspect and/or the surrounding environment.

Another problem that often manifests itself under conditions described above is proper orientation of the key shank and double-lock engaging stem. Handcuff keys are generally carried either in a pocket or attached to an officer's uniform by way of a chain or key ring. Typically upon retrieval, the orientation of a key is unknown until an officer visually inspects the key. In other words, an officer must generally see a key to ensure that the proper end of the key is utilized and the direction of unlocking tab or paddle. Although time is usually of the essence, the cylindrical or symmetrical nature of prior art keys often makes it difficult to quickly ascertain the orientation of a prior art key through an inspection based on touch or feel. Furthermore, if the paddle-bearing end of the key is to be used, the direction of the paddle must be ascertained. Again, orientation requires additional time, and more seriously, distracts the attention of the officer.

Under any condition, a handcuff key should be readily accessible and useable without undue loss of time during retrieval. As explained above, most keys are carried either in a pocket or attached to an officer's uniform. If a key is carried in a pocket of the officer's uniform, the correct pocket must be ascertained, and then the officer must retrieve the key, tying up one hand in the process. Although a key attached to the outside of an officer's uniform may be more easily accessible, the key must be detached from the uniform. In some cases, an attachment link is pivotally mounted on the key adjacent either the engagement stem or the unlocking paddle so that the link extends over the end of the key. This link permits the key to be secured to a chain, key ring, or similar device, and to swing freely therefrom. However, because the link is generally attached to pivot adjacent either the stem or the paddle, it can interfere with use of that mechanism during locking and unlocking. Therefore, the link must be secured in a non-interfering position. In either case, retrieval and use of such a key requires time and attention. In instances where a plurality of keys are attached to a single key ring, this problem is exacerbated.

Finally, the engagement stem of the double-lock keys of the prior art extends from the end of the key opposite the end of the shank bearing the unlocking paddle. Often, the exposed stem has a tendency to snag on clothing and, in some cases, puncture one's skin.

Therefore, it would be desirable to provide a handcuff key that can readily seat in a handcuff keyhole to aid in the alignment of the key with the keyhole. In addition, it would be desirable to provide means for properly orienting a handcuff key by touch such that an officer need not visually inspect the key in order to insert it into a handcuff. The key should be easily retrievable without the need to remove or secure interfering attachments before use. Lastly, it would be desirable to protect the double-lock stem when the key is not in use.

SUMMARY OF THE INVENTION

The subject invention provides a handcuff key which is easily seated in a handcuff keyhole to aid in self-alignment of the key with the keyhole. In addition, various features of the key permit the key to be quickly and properly oriented by touch. The key is also provided with a quick-release cap which covers the double-lock stem, yet permits easy access and retrieval as well as unobstructed use during handcuff locking and unlocking.

The key is provided with a shank on which is mounted a paddle. Unlike the keys of the prior art, the paddle is offset from the end of the shank, so that a portion of the shank protrudes beyond the end of the paddle. Furthermore, the key has a first asymmetrical gripping surface as well as a second cylindrical gripping surface. The key is also provided with a quick releases cap which snaps over the double-lock stem. In an alternative embodiment, the quick-release cap is provided with an offset key ring to permit the key to hang substantially vertical from an officer's uniform or key ring during storage. Finally, the key is fabricated of dissimilar materials such as an elastomer and a metal, to enhance the service life of the key and to enhance gripability during use.

DETAILED DESCRIPTION OF THE PREFERRED EMBODIMENTS

Figure 2:
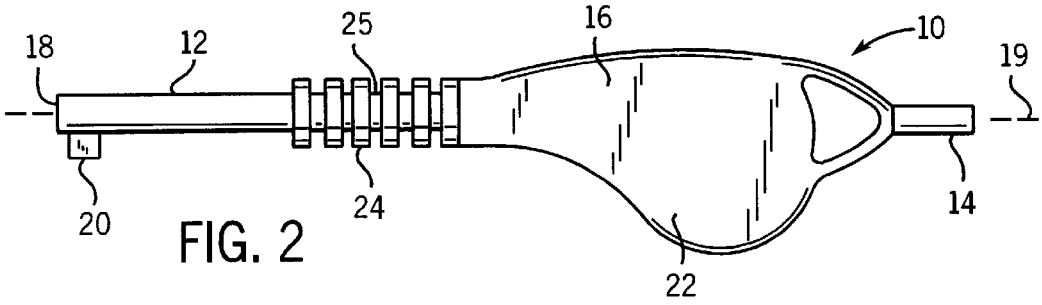
FIG. 2 is an elevational side view of a handcuff key having an offset locking paddle and an asymmetric orientation feature.

A handcuff key of the present invention is shown in FIG. 2 and generally designated as 10. Key 10 is provided with a partially hollow shank 12 and a double-lock stem 14 located on opposing ends of key 10, and a gripping surface 16 located therebetween. Offset from the end 18 of shank 12 is locking paddle 20. Gripping surface 16 is defined in part by an asymmetric teardrop 22 extending in the same plane as locking paddle 20. Additionally, key 10 is provided with molded ridges 24 at the intersection of gripping surface 16 and shank 12. Ridges 24 are spaced apart along shank 12 to define annular grooves 25 therebetween.

Figure 1A:
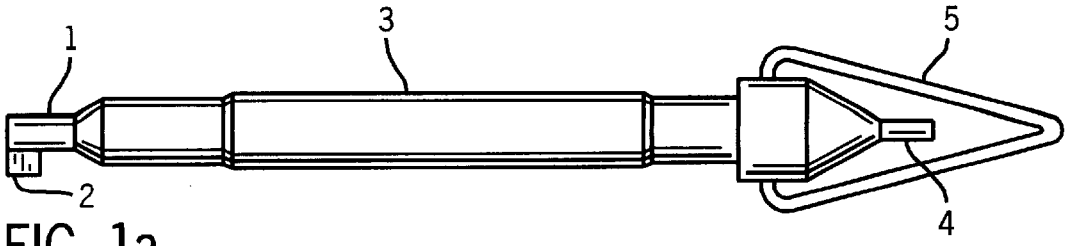
FIG. 1a PRIOR ART
FIG. 1*a* is a perspective view of a cylindrical prior art handcuff key having an attachment link.
Figure 1B:
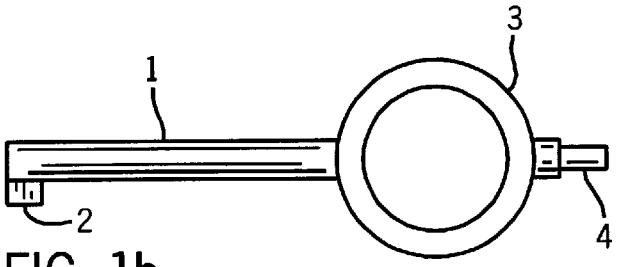
FIG. 1b PRIOR ART
FIG. 1*b* is a perspective view of a symmetrical prior art handcuff key.
Figure 3:
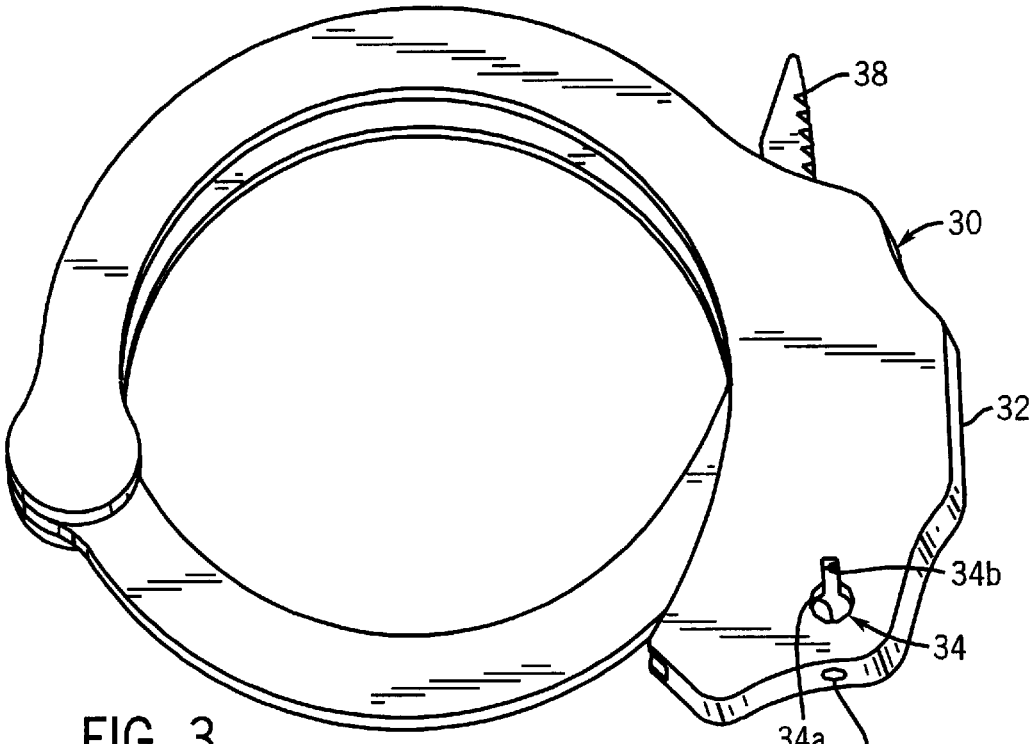
FIG. 3 PRIOR ART
FIG. 3 is an elevational view of a standard handcuff with a standard keyhole.
Figure 4A:
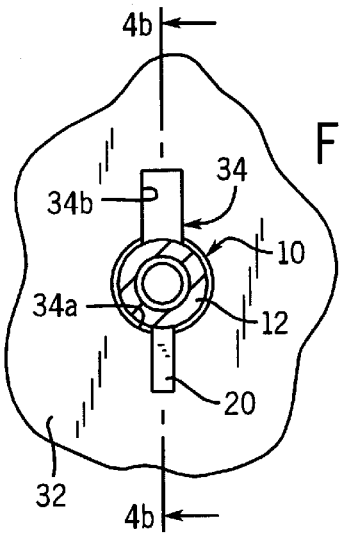
FIG. 4*a* is a top, cut-away view of the handcuff key of FIG. 2, seated in the keyhole of the handcuff of FIG. 3.
Figure 4B:
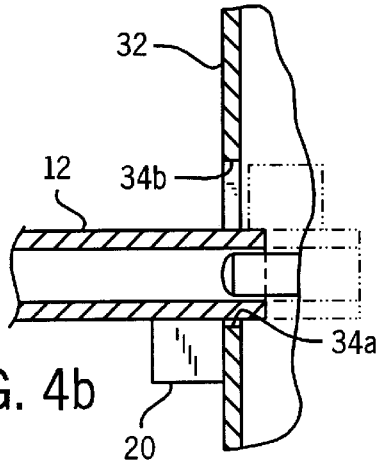
FIG. 4*b* is a cut-away side view of the key of FIG. 4*a*.

With reference to FIGS. 3, 4*a,* and 4*b,* a standard handcuff 30 is shown, wherein handcuff 30 has a base 32, a keyhole 34, a double-lock aperture 36 and a ratchet arm 38. Keyhole 34 is defined by an annular aperture 34*a* intersecting a rectangular notch 34*b*. This shape corresponds to the cross-sectional shape of end 18 of shank 20. As is most easily seen in FIG. 4*b,* end 18 of shank 12 protrudes past paddle 20 so that shank 12 can seat in annular aperture 34*a* even before paddle 20 is aligned with rectangular notch 34*b*. Once end 18 has seated in annular aperture 34*a,* key 10 can simply be rotated until paddle 20 is aligned with notch 34*b*. By offsetting paddle 20 on shank 12, it is no longer necessary to align both shank 12 and paddle 20 before inserting key 10 into handcuff 30. As such, key 10 is more readily utilized with handcuff 30, even under less than desirable environmental conditions. In the preferred embodiment, paddle 20 is offset from end 18 by approximately 0.0025–0.0030 inch, although it has been found than offsets of more than 0.0010 inch will suffice.

Key 10 is also provided with various geometric features that enhance the ease in orienting key 10 for use with handcuff 30, namely teardrop 22 of gripping surface 16 and molded ridges 24. As explained above, these features permit a user to ascertain the orientation of key 10, i.e., the forward and rearward end of key 10 as well as the direction of paddle 20, simply by touch without the need to visually inspect key 10. Turning back to FIG. 2, teardrop 22 can be seen extending down from the centerline 19 of shank 12. Although teardrop 22 can have any positional relationship relative to paddle 20, in the preferred embodiment teardrop 22 is in the same plane as paddle 20 and extends in the same direction as paddle 20. As such, by simply ascertaining the location of teardrop 22 on key 10 by touch, the orientation of paddle 20 can be determined. Those skilled in the art will understand that gripping surface 16, and especially teardrop 22, can have any shape as long as gripping surface 16 is asymmetric about centerline 19. It has been found that the best results are achieved when the distance between the outer edge of teardrop 22 and centerline 19 is substantially greater than the centerline distance to any other part of key 10. Because of the distended nature of teardrop 22, the orientation of key 10 can be easily and quickly ascertained with certainty.

In addition to asymmetrically shaped gripping surface 16, molded ridges 24 further increase a users ability to properly orient key 10 simply by touch. By positioning ridges 24 between gripping surface 16 and paddle 20, the user can quickly and easily locate the forward end of key 10, i.e., the paddle-bearing end. As with teardrop 22, ridges 24 are preferably shaped in a manner that is substantially different than any other part of key 10. In the preferred embodiment, ridges 24 are circular in shape, with an outer diameter which is substantially larger than the diameter of shank 12. In addition, ridges 24 are shaped to form lands and grooves which further enhance the recognizable "feel" of ridges 24 relative to the other geometric features of key 10. Of course, those skilled in the art will understand that the particular shape of ridges 24 can have any shape as long as it is distinguishable from other parts of key 10. In another embodiment, for example, ridges 24 can have a square cross-section, or the surface of ridges 24 can be dimpled or raised rather than grooved. Finally, molded ridges 24 are desirable because they enhance a users ability to grasp and turn key 10. Specifically, ridges 24 will permit the user to maintain a secure grip on key 10 even if key 10 has become soiled with dirt, water or other debris. In any case, under adverse conditions, ridges 24 permit a user to quickly and easily identify the orientation of key 10 without the need to momentarily distract ones attention for a visual inspection of key 10.

Figure 5:
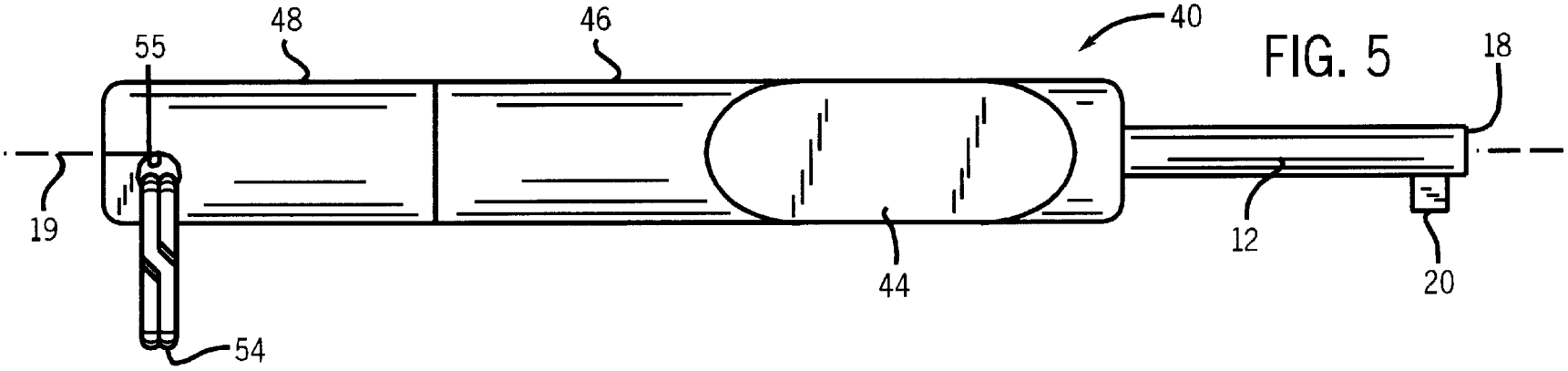
FIG. 5 is a side view of a second embodiment of the invention with an offset locking paddle and a covered double-lock stem.
Figure 6:
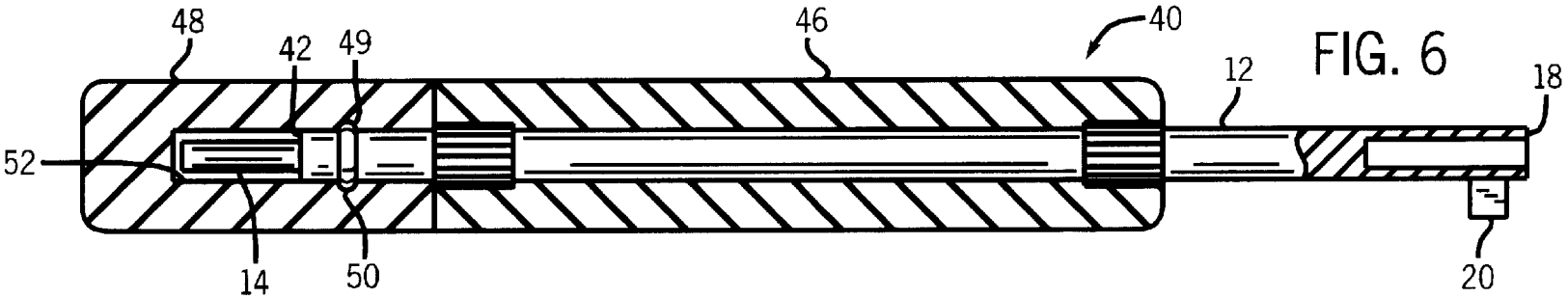
FIG. 6 is a cut-away side view of the key of FIG. 5.
Figure 7:
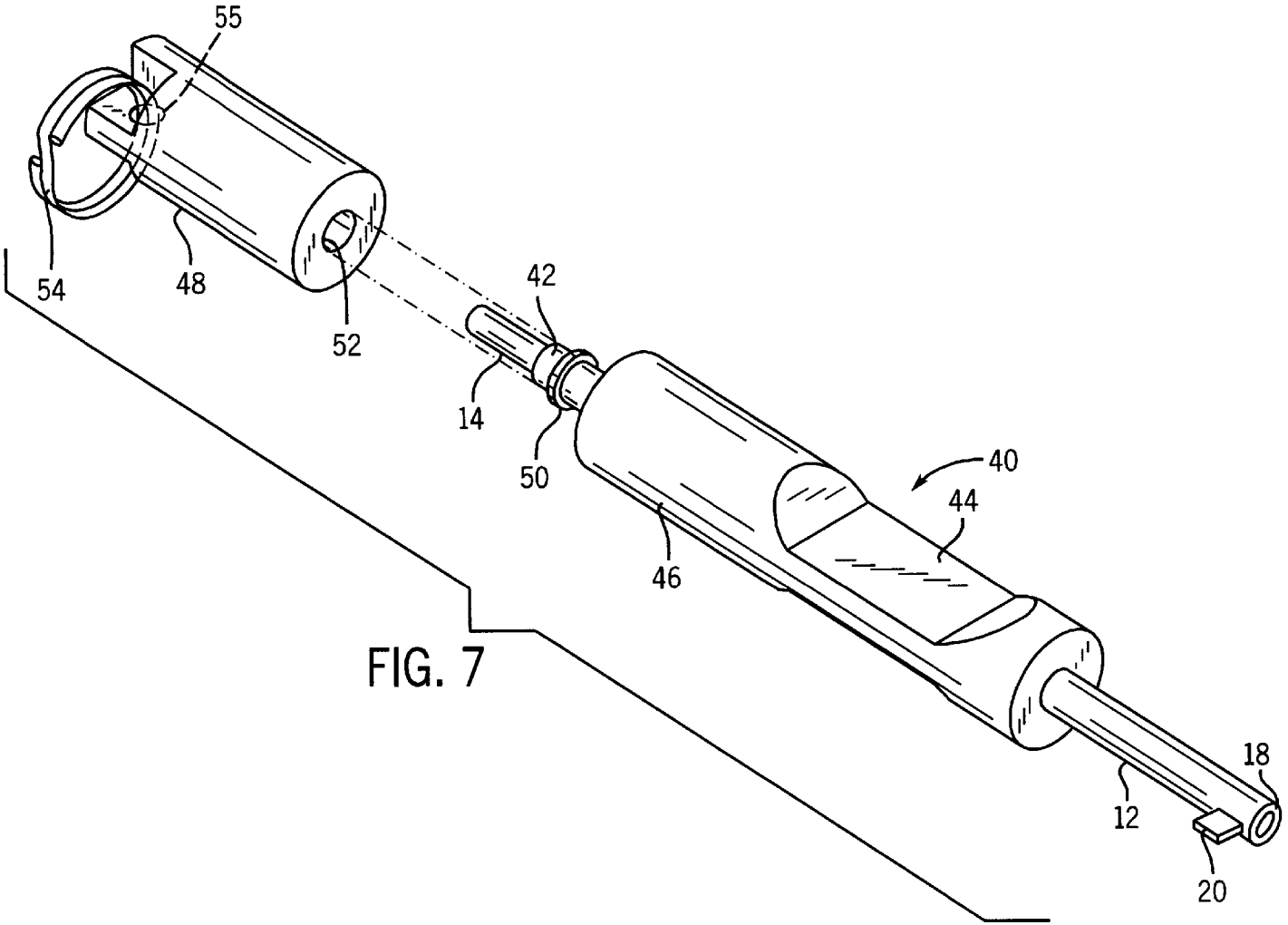
FIG. 7 is a partial exploded view of the key of FIG. 5.

Turning now to FIGS. 5–7, another embodiment of the invention is shown as key 40. Key 40 comprises a partially hollow shank 12 on which is mounted a locking paddle 20 at end 18 and a double-lock stem 14 at end 42. A gripping surface 44 is located therebetween. Gripping surface 44 is an integral part of key body 46 which extends substantially along the length of shank 12. Again, locking paddle 20 is offset from end 18 of shank 12 to permit key 40 to seat in handcuff keyhole 34 (FIG. 3) before alignment. Key 40 is also provided with a removably attached cap 48 having an annular bore 52 which extends partially therethrough (FIGS. 6 and 7) and an annular groove 49 disposed within bore 52. Annular groove 49 is adapted to mate with a rib 50 provided at the end 42 of shank 12. To maintain a secure engagement between key 40 and cap 48, the outer diameter of rib 50 is typically greater than the inner diameter of bore 52. When groove 49 and rib 50 are engaged, stem 14 is disposed to extend into bore 52.

In the one embodiment, cap 48, as well as key body 46 is formed of an elastomer, while shank 12, paddle 20, and stem 14 are fabricated of metal. Preferably, cap 48 is formed of an elastomer of sufficient resiliency to permit rib 50 to pass readily within bore 52, yet once rib 50 is seated within groove 49, to maintain a secure engagement between key 40 and cap 48. As such, while key 40 is held firmly engaged by cap 48, key 40 can easily turn or spin relative to cap 48. This feature is desirable because a user can easily rotate key 40 for engagement with a keyhole without the need to separate key 40 from cap 48 or turn or manipulate a key ring (not shown) to which key 40 may be attached. Although not intended to limit the invention, an elastomer of 60 durometer material has been found suitable.

Cap 48 is also provided with a ring 54 to permit attachment of key 40 to a uniform (not shown), key ring (not shown) or similar device. Ring 54 is fed through key ring hole 55. When cap 48 is mounted to shank 12 as shown in FIGS. 4 and 5, key 40 can be suspended from ring 54 during non-use. When key 40 is needed, an axial force applied by way of gripping surface 44 will permit cap 48 to be separated or disengaged from shank 12, exposing stem 14 and permitting either end of key shank 12, i.e., locking paddle 20 or double lock stem 14, to be utilized without interference by cap 48. Once handcuff locking or unlocking is complete, key 40 can once again be stored by simply snapping end 42 back into engagement with cap 48. Therefore, cap 48 provides a means by which key 40 can be quickly detached from one's uniform or clothing, and yet be retained in an easily accessible location.

Still yet another function of cap 48 is to cover stem 14 when key 40 is not in use, thus preventing stem 14 from snagging clothing or puncturing one's skin. In another embodiment, ring 54 is offset from centerline 19 to permit key 40 to hang substantially vertical when suspended as described above.

In addition to the above-described benefits, the combination of dissimilar materials has been found to extend the life of key 40, while enhancing the gripability of key 40. In contrast, the handcuff keys of the prior art are formed of only one material, typically metal. Thus, while the portions of key 40 which are used to actuate handcuffs remain rigid, the elastomer provides a better surface for gripping due to friction than would a metal surface.

In undesirable conditions such as those described above, these dissimilar materials permit key 40 to be more effectively manipulated and used than the handcuff keys of the prior art.

Figure 8:
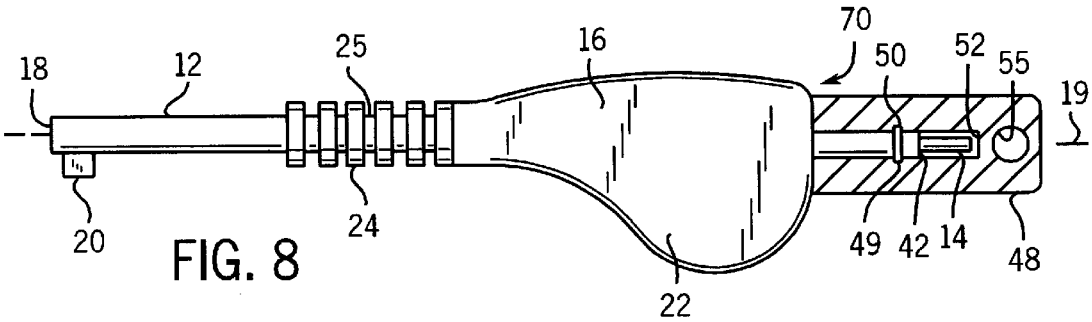
FIG. 8 is a partial cut-away side view of another embodiment of the invention incorporating various features of the other embodiments.

Another embodiment of the invention is shown in FIG. 8 and designated as key 70. Key 70 incorporates various features from the previously described embodiments, such as the offset paddle 20, the gripping surface 16 having an asymmetric teardrop 22, molded ridges 24 forming annular grooves 25, and double lock stem 14 covered by cap 48.

While certain features and embodiments of the invention have been described in detail herein, it will be readily understood that the invention encompasses all modifications and enhancements within the scope and spirit of the following claims.

What is claimed is:

1. A handcuff key for use with a handcuff having a base, a keyhole, a double-lock aperture and a ratchet arm, the keyhole including an annular aperture and a notch, the annular aperture of the keyhole being defined by an inner diameter of the keyhole and an outer diameter of a circular post, the handcuff key comprising:

a. a gripping surface;

b. an elongated shank attached to the gripping surface, the shank having an end surface free of coding notches and an axis;

c. means for aligning the shank with the annular aperture of the handcuff keyhole, the aligning means comprising an axial bore extending into the shank along the axis from the end surface, the axial bore is adapted to receive the post upon insertion of the handcuff key into the aperture of the keyhole; and d. means for orienting the shank with the notch of the handcuff keyhole, the orienting means being spaced a predetermined distance from the end surface such that upon partial insertion of the shank of the handcuff key into the annular aperture of the handcuff keyhole, the shank can be rotated about the post to allow the orienting means to be oriented with the notch, where the shank may be fully inserted into the aperture once the orienting means is oriented with the notch.

2. The handcuff key of claim 1 wherein the orienting means comprises an unlocking paddle attached to the shank and offset from the end surface.

3. The handcuff key of claim 2 wherein the paddle is offset a distance from the end surface in the range of 0.0025–0.0030 inches.

4. The handcuff key of claim 2 wherein the paddle is offset more than 0.0010 inch from the end surface.

5. The handcuff key of claim 2 wherein the gripping surface is asymmetrical about the axis of the shank, the gripping surface further comprising an extending portion co-planar with the paddle to assist in orienting the paddle with the rectangular notch of the keyhole.

6. The handcuff key of claim 5 wherein the extending portion of the gripping surface is teardrop shaped.

7. The handcuff key of claim 1 further comprising a shaped surface disposed on the shank to assist in ascertaining the orientation of the key.

8. The handcuff key of claim 7 wherein the shaped surface comprises a series of annular grooves.

9. A handcuff key for use with a handcuff having a base, a keyhole, a double-lock aperture and a ratchet arm, the keyhole including an annular aperture and a notch, the annular aperture of the keyhole being defined by an inner diameter of the keyhole and an outer diameter of a circular post, the handcuff key comprising:

a. a gripping surface;

b. an elongated shank attached to the gripping surface, the shank having an end surface free of coding notches and an axis;

c. an unlocking paddle attached to the shank and offset from the end surface; and d. means for seating the end surface of the shank within the annular aperture of the handcuff keyhole irrespective of the position of the paddle with respect to the notch of the handcuff keyhole, the seating means comprising an axial bore extending into the shank along the axis from the end surface, the axial bore is adapted to receive the post upon insertion of the key into the aperture of the handcuff keyhole, the paddle being spaced a predetermined distance from the end surface such that upon partial insertion of the shank of the handcuff key into the annular aperture of the handcuff keyhole, the shank can be rotated about the post to allow the paddle to be oriented with the notch, where the shank may be fully inserted into the aperture once the paddle is oriented with the notch.

10. A combination of a handcuff and a handcuff key comprising:

a. a handcuff having a base, a keyhole, a double-lock aperture and a ratchet arm, the keyhole including an annular aperture and a notch, the annular aperture of the keyhole being defined by an inner diameter of the keyhole and an outer diameter of a circular post, b. a handcuff key comprising:

a gripping surface;

an elongated shank attached to the gripping surface, the shank having an end surface and an axis;

means for aligning the shank with the annular aperture of the handcuff keyhole, the aligning means comprising an axial bore extending into the shank along the axis from the end surface, the axial bore is adapted to receive the post upon insertion of the key into the annular aperture of the keyhole; and means for orienting the shank with the notch of the handcuff keyhole, wherein upon partial insertion of the shank of the key into the annular aperture of the keyhole, the shank can be rotated about the post to allow the orienting means to be oriented with the notch, where the shank may be fully inserted into the annular aperture once the orienting means is oriented with the notch.

11. The combination of claim 10 wherein the orienting means comprises an unlocking paddle attached to the shank and offset from the end surface.

12. The combination of claim 11 wherein the paddle is offset a distance from the end surface in the range of 0.0025–0.0030 inches.

13. The combination of claim 11 wherein the paddle is offset more than 0.0010 inch from the end surface.

14. The combination of claim 11 wherein the gripping surface is asymmetrical about the axis of the shank, the gripping surface further comprising an extending portion co-planar with the paddle to assist in orienting the paddle with the notch of the keyhole.

15. The combination of claim 14 wherein the extending portion of the gripping surface is teardrop shaped.

16. The combination of claim 10 further comprising a shaped surface disposed on the shank to assist in ascertaining the orientation of the key.

17. The combination of claim 16 wherein the shaped surface comprises a series of annular grooves.

18. A handcuff key comprising:

a. an elongated shank having a first end, a second end, an axis, and end surface at the first end, an axial bore extending into the shank along the axis from the end surface, and an annular ridge disposed at the second end;

b. a double lock stem axially extending from said second end;

c. an unlocking paddle mounted on said first end and offset from said end surface;

d. a teardrop shaped gripping surface attached to said shank between said first and second ends, wherein said gripping surface is asymmetrical about the axis of said shank;

e. a shaped surface disposed on said shank, wherein said shaped surface comprises at least one annular groove; and f. a cap which is detachable engaged with the second end of said shank, said cap comprises an axial bore extending partially therethrough and an annular groove disposed within said bore, said groove adapted to mate with the annular ridge of said shank such that said stem extends into said bore.

19. A handcuff key comprising:

a. an elongated shank defined along an axis, said shank having a first end with an end surface and a second end;

b. an unlocking paddle attached to the first end of said shank adjacent said end surface;

c. a gripping surface mounted on said shank between the first and second ends; and d. a cap which is detachably engaged with the second end of said shank.

20. The handcuff key of claim 19 further comprising a stem mounted on the second end of said shank.

21. The handcuff key of claim 20 wherein said elongated shank includes an annular ridge disposed around the second end of said shank adjacent said stem.

22. The handcuff key of claim 21 wherein said cap comprises an axial bore extending partially therethrough and an annular groove disposed within said bore, said groove adapted to mate with the annular ridge of said shank such that said stem extends into said bore.

23. The handcuff key of claim 19 wherein said gripping surface is asymmetrical about the axis of said shank.

24. The handcuff key of claim 19 further comprising a shaped surface disposed on said shank.

25. The handcuff key of claim 24 wherein said shaped surface comprises at least one annular groove.

26. The handcuff key of claim 19 wherein said paddle is offset from said end surface of said shank.

27. The handcuff key of claim 22 wherein said cap further defines an annular through bore extending substantially perpendicular to said axial bore.

28. The handcuff key of claim 24 wherein said through bore is offset from the axis of said shank.

29. The handcuff key of claim 19 wherein said cap is formed of an elastomer.

30. The handcuff key of claim 26, wherein said shank further comprises an axial bore extending into the shank along the axis from the end surface.

* * * * *